United States Patent [19]

Kalvaitis et al.

[11] Patent Number: 4,806,710

[45] Date of Patent: Feb. 21, 1989

[54] MECHANICAL DOOR INTERLOCK FOR ELECTRICAL EQUIPMENT ENCLOSURE

[75] Inventors: Arvydas J. Kalvaitis, Northbrook; Edmund S. Dizon; Kenneth K. Tso, both of Chicago, all of Ill.

[73] Assignee: S&C Electric Company, Chicago, Ill.

[21] Appl. No.: 95,280

[22] Filed: Sep. 10, 1987

[51] Int. Cl.[4] ..... H01H 9/20

[52] U.S. Cl. ..... 200/50 A

[58] Field of Search ..... 200/50 R, 50 A, 50 AA, 200/50 B, 329, 330, 50; 361/334, 335–337, 339, 343, 344

[56] References Cited

U.S. PATENT DOCUMENTS

| | | | |
|---|---|---|---|
| 2,930,940 | 3/1960 | Trumpler | 361/343 X |
| 3,296,393 | 1/1967 | Rimmer et al. | 200/50 A |
| 3,339,118 | 8/1967 | Harner et al. | 361/339 |
| 3,385,938 | 5/1968 | Schockelt | 200/50 R |
| 3,748,621 | 7/1973 | Sakats | 337/173 |
| 3,778,567 | 12/1973 | Davies | 200/50 A |
| 3,790,861 | 2/1974 | Sakats | 361/339 |
| 3,882,291 | 5/1975 | Chiboroski | 200/50 A |
| 3,991,291 | 11/1976 | McGuffie et al. | 200/50 A |
| 4,034,169 | 7/1977 | Armstrong et al. | 200/50 A |
| 4,073,000 | 2/1978 | Krejsa | 361/344 |
| 4,118,607 | 10/1978 | Shaffer | 200/50 A |
| 4,405,844 | 9/1983 | Dizon et al. | 200/50 A |

*Primary Examiner*—J. R. Scott

*Attorney, Agent, or Firm*—James V. Lapacek

[57] ABSTRACT

A door interlock is provided for an electrical equipment enclosure which includes a drive/latch member carried by the door and a locking member carried by the enclosure. The drive/latch member is biased to a first position and movable into a second position. When the door is closed and latched, the drive/latch member is moved from the first position into the second position. During movement between the first and second positions, the drive/latch member engages the locking member and moves the locking member from a first position wherein a switch is prevented from being closed into a second position wherein the switch is permitted to be closed. When the switch is closed, the locking member is retained in the second position; the drive/latch member being retained in the second position by the locking member. With the drive/latch member in the second position, the door is prevented from being opened by cooperation with facilities carried by the enclosure. Accordingly, the door is held latched until the switch is opened, which returns the locking member to the first position and releases the drive/latch member. In a specific arrangement, the drive/latch member includes a protruding member which engages the locking member to drive the locking member to the second position. The locking member includes a hooked portion which, in the respective second positions, engages the protruding member of the drive/latch member to hold the drive/latch member in the second position. Additionally, the drive/latch member includes a hooked portion and the locking member pivots about a pivot pin. In the respective second positions, the hooked portion of the drive/latch member engages the pivot pin to prevent the door from being opened. Thus, the structure and cooperation of the locking member, the drive/latch member, and the pivot pin prevent movement of the drive/latch member relative to the locking member until the locking member is moved out of the second position after the switch is opened.

17 Claims, 2 Drawing Sheets

MECHANICAL DOOR INTERLOCK FOR ELECTRICAL EQUIPMENT ENCLOSURE

BACKGROUND OF THE INVENTION

1. Field of the Invention

The present invention relates generally to the fields of interlocks and more particularly to a mechanical door interlock for an electrical equipment enclosure. The interlock enables the door to be opened only when the electrical apparatus is in a predetermined condition and prevents the condition of the electrical apparatus from being changed when the door is open.

2. Description of the Related Art

Various door interlocks for electrical equipment enclosures are known. In typical applications, the interlock is associated with a switch in order to permit the door to be opened only when the switch is open, and to prevent the switch from being closed while the door is opened. Reference may be made to the following U.S. Patents for examples of interlocks: U.S. Pat. Nos. 4,405,844; 4,073,000; 3,790,861; 3,748,621; 3,339,118, 4,118,607; 4,034,169; 3,991,291; 3,882,291; 3,778,567; 3,296,393; and 3,385,938.

Considering the structure and operation of the interlock of commonly assigned U.S. Pat. No. 4,405,844 and referring to FIG. 3B of that patent, with the switch in the closed position, the locking arm 58 is incapable of pivoting due to the position of a cam 50 carried by the switch shaft 38. The locking arm 58 is connected to a cam follower 100 via a wire 65 of a control cable 65. Since the locking arm 58 is incapable of pivoting, the cam follower 100 is also unable to pivot clockwise under the spring bias of a spring 108. Accordingly, the door latch 116 is maintained in a doorlatching position since the portion 120 of the door latch 116 is prevented from pivoting due to the interaction of the projection 102 on the cam follower 100. Additionally, with the door opened, the switch cannot be closed due to the stud 62 of the locking cam 58 preventing rotation of the cam 50 affixed to the switch shaft 38.

While the various interlocks of the prior art may be generally suitable for their intended uses and respective enclosures, it would be desirable to provide a new interlock that is suitable for a new door-latching system; i.e., an interlock that incorporates an appropriate design for a door-latching arrangement which includes a rotatable shaft which drives latching hooks into engagement about latch pins.

SUMMARY OF THE INVENTION

Accordingly, it is a principal object of the present invention to provide a door interlock for an electrical equipment enclosure wherein the interlock prevents a switch from being closed when the door is not latched and includes a drive/latch member carried by the door and a locking member carried by the enclosure which cooperate to retain the drive/latch member in a position to prevent the door from being opened when the switch is in the closed position.

These and other objects of the present invention are efficiently achieved by a door interlock for an electrical equipment enclosure which includes a drive/latch member carried by the door and a locking member carried by the enclosure. The drive/latch member is biased to a first position and movable into a second position. When the door is closed and latched, the drive/latch member is moved from the first position into the second position. During movement between the first and second positions, the drive/latch member engages the locking member and moves the locking member from a first position wherein a switch is prevented from being closed into a second position wherein the switch is permitted to be closed. When the switch is closed, the locking member is retained in the second position; the drive/latch member being retained in the second position by the locking member. With the drive/latch member in the second position, the door is prevented from being opened by cooperation with facilities carried by the enclosure. Accordingly, the door is held latched until the switch is opened, which returns the locking member to the first position and releases the drive/latch member. In a specific arrangement, the drive/latch member includes a protruding member which engages the locking member to drive the locking member to the second position. The locking member includes a hooked portion which, in the respective second positions, engages the protruding member of the drive/latch member to hold the drive/latch member in the second position. Additionally, the drive/latch member includes a hooked portion and the locking member pivots about a pivot pin. In the respective second positions, the hooked portion of the drive/latch member engages the pivot pin to prevent the door from being opened. Thus, the structure and cooperation of the locking member, the drive/latch member, and the pivot pin prevent movement of the drive/latch member relative to the locking member until the locking member is moved out of the second position after the switch is opened.

BRIEF DESCRIPTION OF THE DRAWING

The invention, both as to its organization and method of operation, together with further objects and advantages thereof, will best be understood by reference to the following specification taken in conjunction with the accompanying drawing in which like reference characters refer to like elements and in which:

FIG. 2A illustrating a condition where the switch is open and the door is unlatched; FIG. 2B illustrating a condition where the door is latched closed; and FIG. 2C illustrating the condition where the switch is closed and the door cannot be opened.

DETAILED DESCRIPTION

Figure 1:
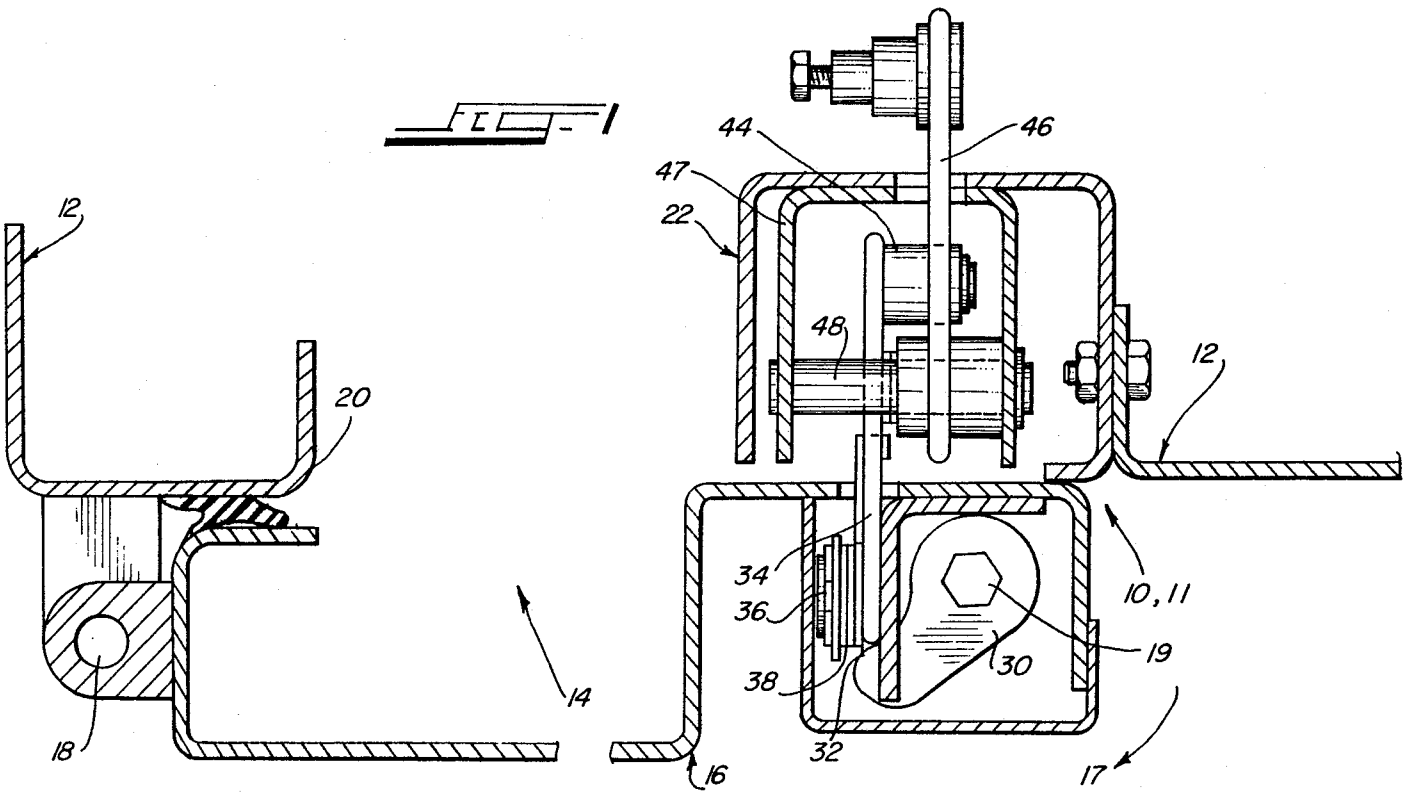
FIG. 1 is a top plan view, partly in section and with parts cut away, of an electrical equipment enclosure incorporating the door interlock of the present invention.

Referring now to FIGS. 1 and 2, a door interlock 10 according to the present invention is illustrated for use with an electrical switchgear enclosure 12. The interlock 10 is utilized to control access to the enclosure via an opening 14 covered by a door 16. The door 16 is pivotally mounted at hinge 18 to a wall 20 of the enclosure 12. The door 16 is opened in the direction 17 to allow access to the interior of the enclosure 12 through the opening 14. To open the door 16, a suitable handle (not shown) is operated to rotate the hex shaft 19 carried by the door 16. If the interlock 10 is in the appropriate condition (as will be explained in more detail hereinafter), the door 16 is then released from the enclosure 12 and can be opened. Similarly, the door 16 is closed and latched by rotating the hex shaft 19.

A door control portion 11 of the interlock 10 cooperates between the door 16 and a channel member 22 of the enclosure 12. A switch control portion 13 (FIG. 2A) of the interlock 10 cooperates between the enclosure 12 and a control shaft 24 which is indicative of the open/-closed status of a switch 15.

Figures 2A, 2B, 2C:
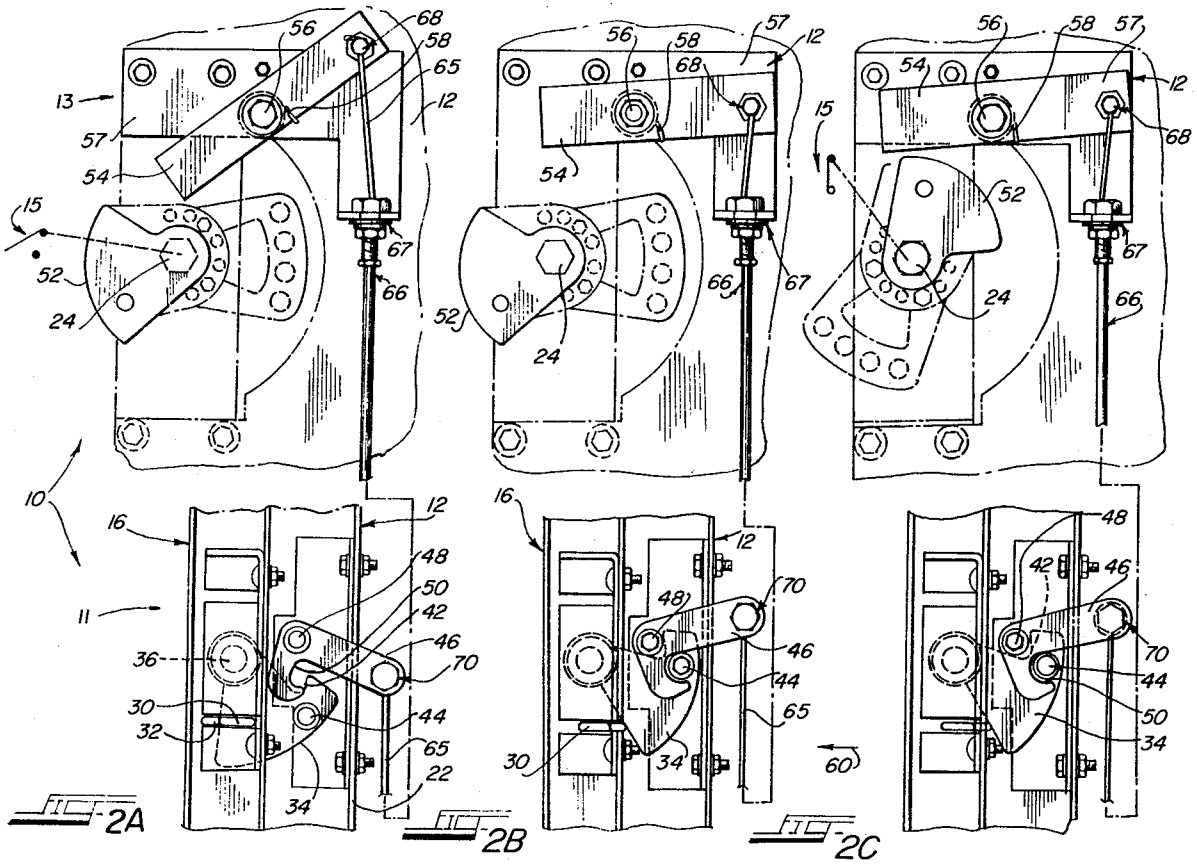
FIGS. 2A, 2B, and 2C are elevational views illustrative of the details of the interlock of the present invention, including a side elevational view of the interlock of FIG. 1.

The interlock 10 is arranged to permit opening of the door 16 only when the control shaft 24 is in a first position indicative of the associated switch 15 being in the open position as shown in FIG. 2A. Further, the interlock 10 prevents the switch 15 from being closed whenever the door 16 is not latched closed. In this manner, the interlock 10 assists qualified personnel to appropriately sequence operation of the switch 15 and the opening of the door 16 to gain access to the interior to the enclosure 12—of course, after observing appropriate safety procedures such as testing for deenergized conditions and applying protective grounds.

Specifically, the door control portion 11 of the interlock 10 includes a drive cam 30 fixedly carried by the hex shaft 19. As can be seen in FIGS. 1 and 2A, the drive cam 30 includes an engagement surface 32 that engages a drive/latch member 34 upon rotation of the hex shaft 19 (clockwise in FIG. 1). The drive/latch member 34 is pivotally carried by the door 16 via a pivot pin 36. A spring 38 is arranged about the pivot pin 36 and operates between the drive/latch member 34 and the door 16 to bias the drive/latch member 34 clockwise about the pivot pin 36 to a first position as shown in FIG. 2A. The drive/latch member 34 includes a hooked portion 42 and a stud 44 (FIG. 2A). The door control portion 11 of the interlock 10 also includes a locking member 46 that is pivotally carried via a pivot pin 48. The pivot pin 48 extends through a bracket 47 affixed to the channel member 22 of the enclosure 12. The locking member 46 includes a hooked portion 50 for purposes as will be explained in more detail hereinafter.

Considering now the switch control portion 13 of the interlock 10 (upper portion of FIG. 2A), the switch control portion 13 includes an input cam 52 fixedly carried on the control shaft 24. Additionally, the switch control portion 13 also includes a blocking lever 54 that is pivotally carried via a pivot pin 56 affixed to a bracket 57; the bracket 57 being affixed to the enclosure 12. A spring 58 is arranged about the pivot pin 56 and operates between the blocking lever 54 and the bracket 57 so as to bias the blocking lever 54 in a counterclockwise direction to a first position as shown in FIG. 2A.

A control cable 66 is clamped at a first end to the bracket 57 via a suitable clamping device 67. The control cable 66 includes a movable inner portion or wire 65. The wire 65 is affixed at a first end to the blocking lever 54 via a cable connector 68. The control cable 66 is flexible and may be arranged in a convenient manner and path about the enclosure 12 between the switch control portion 13 of the interlock 10 and the door control portion 11. The wire 65 at the other end is affixed to the locking member 46 via a cable connector 70. Accordingly, the blocking lever 54 through the wire 65 biases the locking member 46 in a clockwise direction to a first position as shown in FIG. 2A.

In FIG. 2A, the position of the input cam 52 corresponds to the open position of the switch 15. If it is attempted to close the switch 15 with resultant clockwise rotation of the switch shaft 24 and the input cam 52, the blocking lever 54 prevents the switch 15 from being moved to the closed position. Correspondingly, the door 16 can be opened by rotation of the hex shaft 19 (counterclockwise in FIG. 1). In a specific embodiment, the enclosure 12 carries latch pins (not shown) and the door 16 carries latching hooks (not shown) which are operated by rotation of the hex shaft 19. In any case, rotation of the hex shaft 19 releases the door 16 for opening.

After the door 16 is closed and latched by rotation of the hex shaft 19 (i.e., after initial rotation of the hex shaft 19 has latched the door), the drive cam 30 rotates the drive/latch member 34 from the first position shown in FIG. 2A. In this manner, latching of the door 16 is assured before the interlock 10 is conditioned to permit the switch 15 to be closed. Upon further rotation of the hex shaft 19 and the drive cam 30 (i.e., going from the first position of FIG. 2A to the second position of FIG. 2B), the stud 44 of the drive/latch member 34 engages and pivots the locking member 46 in a counter-clockwise direction to a second position as shown in FIG. 2B. The pivoting of the locking member 46 to the second position of FIG. 2B also moves the wire 65. The wire 65 pivots the blocking lever 54 clockwise to a second position shown in FIG. 2B.

In the position of FIG. 2B, the door 16 can be opened by rotation of the hex shaft 19, with the drive cam 30, the drive/latch member 34, the locking member 46, and the blocking lever 54 all returning to their respective positions of FIG. 2A.

Alternately, with the components in their respective positions as shown in FIG. 2B with the door latched closed, the switch 15 can be closed with resultant rotation of the control shaft 24 and the input cam 52 to the positions of FIG. 2C since the blocking lever 54 is clear of the path of the input cam 52. With the switch 15 closed such that the input cam 52 is in the position of FIG. 2C, the door 16 cannot be opened. If the hex shaft 19 is rotated, the drive cam 30 is rotated counterclockwise in FIG. 1 and is disengaged from the drive/latch member 34. However, the door 16 cannot be opened (i.e., moved in the direction 60 in FIG. 2C) since the hooked portion 42 of the drive/latch member 34 cannot clear the pivot pin 48. Additionally, due to the engagement of the stud 44 of the hooked portion 50 of the locking member 46, the drive/latch member 34 cannot pivot to the first position of FIG. 2A to clear the pivot pin 48. This occurs even though the door 16 is otherwise unlatched via rotation of the hex shaft 19; i.e., corresponding to the return of the drive cam 30 to the position of FIG. 2A. Thus, until the switch 15 is opened so as to rotate the input cam 52 back to the position of FIG. 2B, the door 16 cannot be opened. This is due to the interaction and cooperation of the drive/latch member 34 and the locking member 46; i.e., the drive/latch member 34 is held in the second position and is prevented from moving relative to the enclosure 12 and the locking member 46. Accordingly, the door 16 is latched regardless of the condition of the door latching arrangement, the hex shaft 19, the drive cam 30, or any other parts of the door 16, including handles, etc.

When the switch 15 is opened, the control shaft 24 and the input cam 52 are rotated back to the positions of FIGS. 2A and 2B. Thereafter, as the hex shaft 19 is rotated, the locking member 46, the blocking lever 54, and the drive/latch member 34 are then free to rotate under spring bias back to their respective positions of FIG. 2A so as to release the door 16. Accordingly, the switch 15 is again prevented from being closed, as discussed hereinbefore in connection with FIG. 2A.

While there have been illustrated and described various embodiments of the present invention, it will be apparent that various changes and modifications will occur to those skilled in the art. For example, while the interlock 10 is described as being arranged to sense the condition of a switch 15, it should be realized that in other specific embodiments, the condition of other electrical components or equipment is sensed/ controlled in place of the switch 15. That is, the first and second conditions of other components correspond to the open and closed state of the switch 15. Thus, the shaft 24 and the input cam 52 function as condition-indicating facilities. Additionally, while the pin 48 (which is engaged by the hooked portion 50 of the drive/latch member 34) is also described as being the pivot pin for the locking member 46, in other specific embodiments, the pin 48 functions solely for engagement by the hooked portion 50 of the drive/latch member 34 and a separate pivotal mounting arrangement is provided for the locking member 46. It is intended in the appended claims to cover all such changes and modifications as fall within the true spirit and scope of the present invention.

What is claimed and desired to be secured by Letters Patent of the United States is:

1. A door interlock for an enclosure having a door, the door interlock comprising:

drive/latch means carried by the door and being biased to a first position and being movable to a second position;

drive cam means being movable from a first position to a second position to move said drive/latch means from said first position to said second position, said drive cam means being movable from said second position to said first position independent of said drive/latch means;

locking means carried by the enclosure and including a locking member that is movable between first and second positions, said locking member being engaged by said drive/latch means and being moved from said first position to said second position while said drive/latch means is moved from said first position to said second position; and means for preventing movement of said drive/latch means relative to said locking member and the enclosure while said locking member is in said second position, said preventing means comprising first means carried by the enclosure being engaged by said drive/latch means, said first means comprising a first member being carried by the enclosure, said drive/latch means including a drive/-latch member that cooperates with said first member, said preventing means further comprising cooperating interengaging means being carried by said locking member and said drive/latch member such that said drive/latch member is retained in said second position while said locking member is in said second position.

2. The door interlock of claim 1 wherein said cooperating interengaging means comprises said locking member including a hooked portion and said drive/latch member including a protruding member that is arranged to be engaged by said hooked portion when said locking member and said drive/latch member are in said second position.

3. The door interlock of claim 2 wherein said drive/-latch member further includes a hooked portion for cooperating with said first member.

4. The door interlock of claim 3 wherein said locking member is pivotally mounted about said first member.

5. The door interlock of claim 1 wherein said locking means further comprises a blocking member movable between first and second positions and means for biasing said blocking member to said first position, said locking means further comprising means for moving said blocking member from said first position to said second position in response to said locking member being moved from said first position to said second position, said moving means further being operative to retain said locking means in said second position when said blocking member is held in said second position.

6. The door interlock of claim 5 wherein said moving means in response to said blocking member returning to said first position permits said locking member to return to said first position.

7. The door interlock of claim 5 wherein said moving means comprises a control cable having a movable portion interconnected between said locking member and said blocking member.

8. The door interlock of claim 1 further comprising condition-responsive means being operable between first and second positions, said locking means comprising means for blocking operation of said condition-responsive means from said first position to said second position when said locking member is in said first position, said blocking means being positioned to permit operation of said condition-responsive means from said first position to said second position when said locking member is moved to said second position.

9. The door interlock of claim 8 wherein said condition-responsive means comprises a cam member movable between first and second positions.

10. A door interlock for an enclosure, the enclosure including a door, the door interlock comprising;

a first member carried by the door and being pivotally mounted for movement between first and second positions;

a second member carried by the enclosure and being pivotally mounted for movement between first and second positions;

a third member being movable independently of said first member and being movable so as to engage said first member to move said first member from said first position to said second position;

means for biasing said first and second members toward said respective first positions, said first member including means for engaging said second member as said first member is moved toward said second position so as to move said second member into said second position;

means for selectively retaining said second member in said second position; and cooperating means for holding said first member in said second position and preventing opening of the door when said second member is retained in said second position by preventing movement of said first member relative to said enclosure and said second member, said cooperating means comprising means interfering with movement of said first member and being carried by said enclosure for preventing movement of said first member relative to the enclosure, said cooperating means further comprising interengaging means carried by said first and second members for holding said first member in said second position and being operative as said first and second members move from said respective first positions to said second positions.

11. The door interlock of claim 10 wherein said selective retaining means comprises a blocking lever and a control cable, said control cable interconnecting said blocking lever and said second member.

12. A door interlock for an enclosure having a door, the door interlock comprising:

a first member carried by the door and being pivotally mounted for movement between first and second positions;

a second member carried by the enclosure and being pivotally mounted for movement between first and second positions;

means for biasing said first and second members toward said respective first positions, said first member including first means for engaging said second member as said first member is moved toward said second position so as to move said second member into said second position, said second member including second means for engaging said first member as said first and second members are moved to said respective second positions so as to retain said first member in said second position as long as said second member is retained in said second position;

a third member being movable between first and second positions to move said first member from said first position to said second position, said third member being movable from said second position to said first position while said first member is retained in said second position; and means for preventing movement of said first member and the door in a predetermined direction when said first and second members are in said respective second positions.

13. The door interlock of claim 12 wherein said movement preventing means comprises a fourth member being carried by the enclosure and said first member including a hooked portion arranged to interact with said fourth member.

14. The door interlock of claim 13 wherein said fourth member pivotally mounts said second member.

15. The door interlock of claim 12 wherein said first means comprises a protruding member carried by said first member and said second member includes a hooked portion that cooperates with said protruding member.

16. A door interlock for an enclosure comprising:

condition-indicating means being selectively operable between a first position and a second position;

blocking means being biased to a first position so as to block said condition-indicating means from moving from said first position to said second position, said blocking means in a second position allowing said condition-indicating means to move from said first position to said second position, said condition-indicating means in said second position holding said blocking means in said second position;

locking means carried by the enclosure being movable between first and second positions;

means for interconnecting said blocking means and said locking means including means responsive to movement of said locking means from said first position to said second position for moving said blocking means from said first position to said second position, said moving means also moving said locking means to said first position when said blocking means is moved to said first position;

drive/latch means being carried by the door and being biased in a first position and being movable to a second position, said drive/latch means when moving from said first position to said second position engaging said locking means and moving said locking means into said second position;

drive cam means being disengagable from said drive/latch member and being movable to engage said drive/latch means to move said drive/latch means from said first position to said second position; and means operative when said drive/latch means is in said second position for holding said drive/latch means from being returned to said first position and for preventing movement of said drive/latch means relative to said locking means and the enclosure, said drive cam means being movable from said second position to said first position while said drive/latch means is held in said second position and prevented from returning to said first position.

17. A door interlock for an enclosure having a door, the door interlock comprising:

drive/latch means carried by the door and including a drive/latch member that is biased to a first position and being movable to a second position;

drive cam means being movable from a first position to a second position to move said drive/latch member from said first position to said second position, said drive cam means being movable from said second position to said first position independent of said drive/latch member;

locking means carried by the enclosure and including a locking member that is movable between first and second positions, said locking member being engaged by said drive/latch member and being moved from said first position to said second position while said drive/latch member is moved from said first position to said second position; and means for preventing movement of said drive/latch member relative to said locking member and the enclosure while said locking member is in said second position, said preventing means comprising first means carried by the enclosure being engaged by said drive/latch member, said first means comprising a first member being carried by the enclosure, said drive/latch member cooperating with said first member, said locking member and said drive/latch member including cooperating structure such that said drive/latch member is retained in said second position by virtue of said locking member being retained in said second position.

* * * * *